United States Patent [19]

Soeno et al.

[11] 4,114,243

[45] Sep. 19, 1978

[54] PROCESS FOR PRODUCING CATHODE FOR CATHODE RAY TUBE OF DIRECTLY HEATING TYPE

[75] Inventors: Ko Soeno; Toshio Doi, both of Hitachi; Tomio Iizuka, Ibaraki; Hiroshi Sakamoto; Hisashi Ando, both of Hitachi; Tetsuo Oyama, Takahagi; Akira Misumi, Mobara, all of Japan

[73] Assignee: Hitachi, Ltd., Japan

[21] Appl. No.: 775,618

[22] Filed: Mar. 8, 1977

[30] Foreign Application Priority Data

Mar. 9, 1976 [JP] Japan ..... 51-24680

[51] Int. Cl.[2] ..... H01J 9/04

[52] U.S. Cl. ..... 29/25.14; 29/25.18; 228/179

[58] Field of Search ..... 313/346 DC; 29/25.11, 29/25.13, 25.14, 25.15, 25.17, 25.18; 228/179

[56] References Cited

U.S. PATENT DOCUMENTS

| | | | |
|---|---|---|---|
| 2,945,295 | 7/1960 | Feaster | 313/346 DC |
| 3,148,056 | 9/1964 | Brodie et al. | 313/346 DC |
| 3,224,071 | 12/1965 | Levi et al. | 29/25.17 X |
| 3,694,688 | 9/1972 | Kuiper et al. | 313/346 DC |

*Primary Examiner*—Richard B. Lazarus

*Attorney, Agent, or Firm*—Craig & Antonelli

[57] ABSTRACT

In a process for producing a cathode for a cathode ray tube of directly heating type, which comprises shaping a heat-resistant and electro-conductive, flat metal plate, into a cathode substrate body having two leg pieces extended in the same direction and a flat part connected to one end of each leg piece, forming a heat-diffusible metal powder layer having a good affinity to said flat metal plate and on an outer surface of said flat part, heating the powder layer, thereby diffusion bonding the powder layer to the flat part and forming a bonding layer having an uneven surface, to which a thermionic emission layer is to be bonded, and forming the thermionic emission layer on the surface of the bonding layer, the process is characterized by forming on said flat metal plate a metal layer having a good affinity to the flat metal plate, by diffusion bonding, thereby forming a compound plate, and shaping the resulting compound plate into the shape of said cathode substrate body. A cathode having less thermal deformation and a longer life can be produced thereby.

Furthermore, the process is characterized by applying a plastic working to the compound plate to a desired thickness and shaping the resulting compound plate into the shape of the cathode substrate body, and a cathode having much less thermal deformation and much longer life can be produced thereby.

24 Claims, 6 Drawing Figures

PROCESS FOR PRODUCING CATHODE FOR CATHODE RAY TUBE OF DIRECTLY HEATING TYPE

This invention relates to a process for producing a novel cathode for a cathode ray tube of directly heating type having a very small thermal deformation.

Cathode ray tubes of directly heating type have less power consumption and considerably shorter starting time from a switch-on of power source to actuation than cathode ray tubes of indirectly heating type, but on the other hand in the cathode ray tubes of directly heating type, an electric current is directly passed through the cathode that emits electron beams, and thus the cathode is rapidly heated and is very liable to undergo thermal deformation. Once the cathode undergoes thermal deformation, the cathode ray tubes fail to exhibit desired characteristics, which is a fatal trouble to the cathode ray tubes.

Description of the invention and the prior art will be made, referring to the accompanying drawings.

Figure 1:
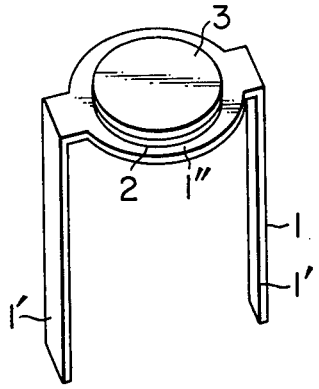

FIG. 1 is a schematic view of a general structure of a cathode for a cathode ray tube of directly heating type.

Figure 2:
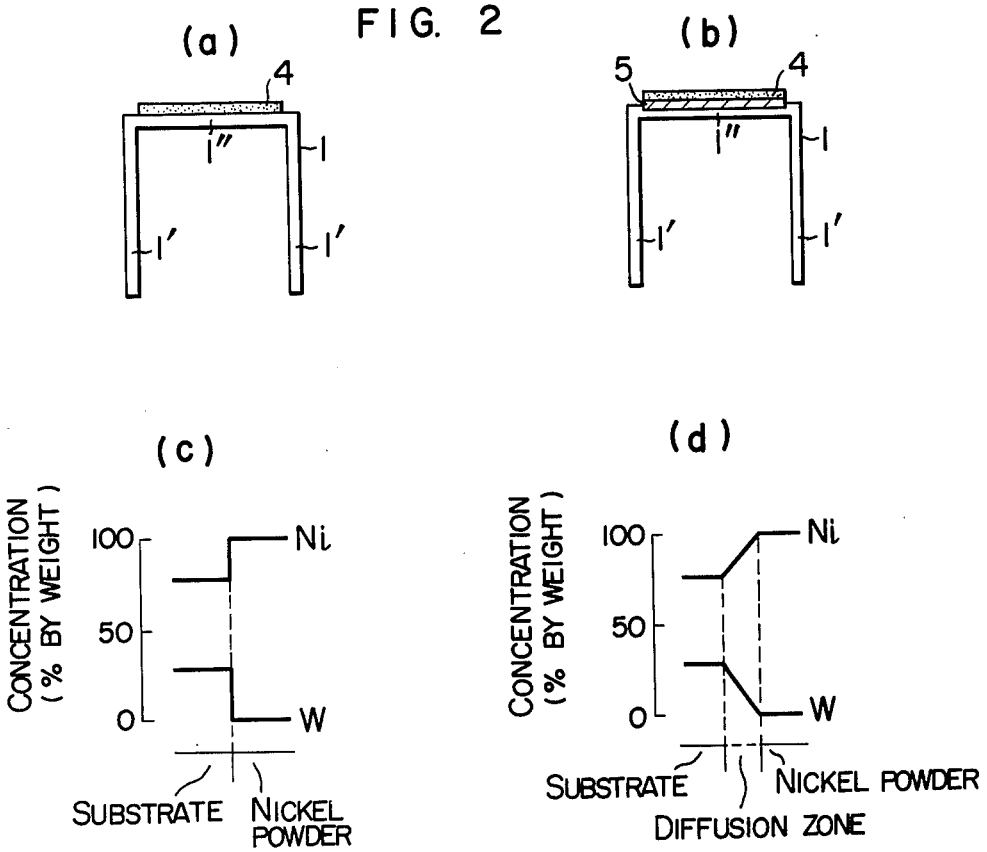

FIG. 2 (*a*), (*b*), (*c*) and (*d*) are views and graphs showing the formation of a diffusion phase between a cathode substrate body and Ni powders, where graphs (c) and (d) show results of W and Ni concentrations by X-ray micro-analyzer.

Figure 3:
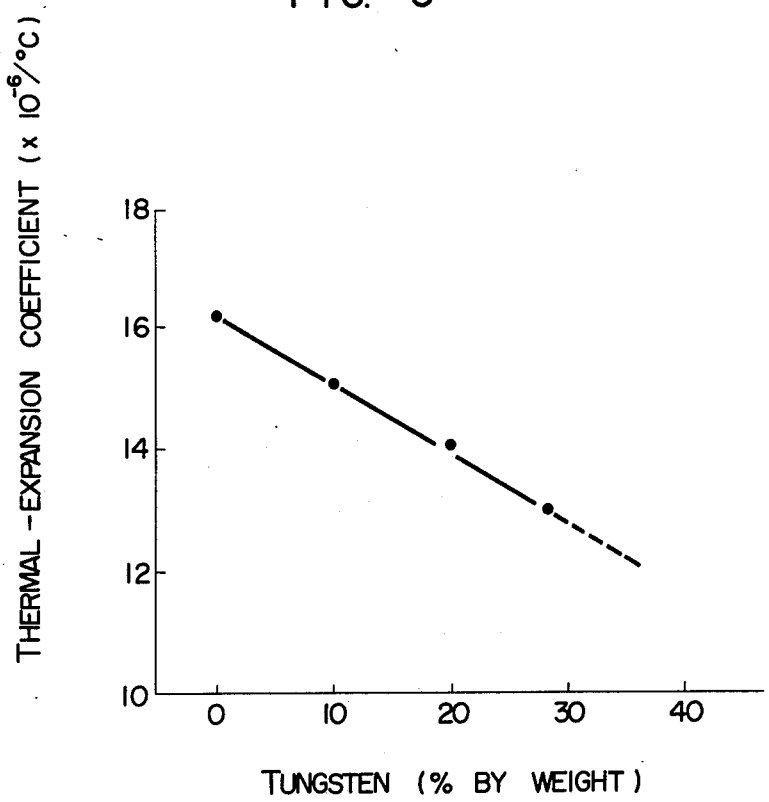

FIG. 3 is a graph showing mean coefficients of thermal expansion of pure Ni and Ni-W alloy from room temperature to 900° C.

In a cathode of ordinary cathode ray tube of directly heating type, a cathode substrate body 1 (leg pieces 1' and flat part 1'') is firmly bonded to a thermoionic emission layer 3 through a bonding layer 2, as shown in FIG. 1. Electric current is directly passed through the cathode substrate body, and thus the substrate body is heated to a high temperature (about 650° to 1,000° C.). That is, the substrate body must have a high strength at the high temperature, and also have an appropriate electric resistance on account of the necessity for heating by the electric current passage, and a good cold processability, as well as the substrate body must be produced easily. Thus, alloy of the following system has been generally deemed to be most appropriate for the substrate body:

15 to 30% by weight of W 0.1 to 1.5% by weight of Zr, and the balance being Ni.

Furthermore, the alloys, a portion or all the portion of whose Ni is replaced with Co, that is, alloys of 15 to 30% by weight of W and 0.1 to 1.5% by weight of Zr, the balance being Co, and alloys of 20 to 50% by weight of Co, 15 to 30% by weight of W, and 0.1 to 1.5% by weight of Zr, the balance being Ni, and the alloys, a portion or all the portion of whose W is replaced with Mo, that is, alloys of 15 to 30% by weight of Mo, 0.1 to 1.5% by weight of Zr, the balance being Ni, and alloys of 8 to 15% by weight of Mo, 7 to 15% by weight of W, and 0.1 to 1.5% by weight of Zr, the balance being Ni, are also appropriate for the cathode substrate body 1.

On the other hand, the thermionic emission layer is a compound oxide obtained by calcining compound carbonates of barium, strontium, and calcium [(Ba, Sr, Ca) $CO_3$] at a high temperature, for example, about 1,000° C. Zr contained in a small amount in the cathode substrate body acts upon the compound oxide as a reducing agent, and plays a role to facilitate the thermoionic emission. The bonding layer makes a bonding between the cathode substrate body and the thermoionic emission layer firm, and is most effectively formed by applying pure Ni powders onto the cathode substrate body and baking the resulting substrate body. That is, a cathode of directly heating type is usually produced by applying pure Ni powders onto said cathode substrate body to a thickness of 1 to 5 mg/cm$^2$, heating the applied substrate body in vacuum at a temperature of about 700° to about 900° C., thereby baking the Ni powders onto the cathode substrate body, applying compound carbonate of barium, strontium and calcium [(Ba, Sr, Ca) $CO_3$] to the baked substrate body, after cooling, to a thickness of 1 to 5 mg/cm$^2$, and again heating the applied substrate body in vacuum at a temperature of about 1,000° C., thereby forming compound oxides and firmly bonding the oxides to the cathode substrate body.

However, it is observed in said process that a thermal deformation takes place at the cathode during the production or during the service, so that the flat part 1'' is bent into a convex form towards the bonding layer, and it is the most important problem in the production of the cathode ray tubes of directly heating type to prevent the thermal deformation of the cathode.

An object of the present invention is to provide a process for producing a cathode of directly heating type free from thermal deformation during the production or service of the cathode.

The present invention has been accomplished on the basis of the following findings.

As a result of studies on the deformation of cathode, the present inventors have found the following three facts. That is, (1) when pure Ni powders are applied to the cathode substrate body, and baked, such a deformation takes place as to elongate the Ni powders baked surface of the cathode, (2) when the compound carbonate is applied to the cathode substrate body after the baking of Ni powder and then baked to compound oxides, such a deformation takes place as to elongate the compound oxides-baked surface of the cathode, and (3) even during the service as a cathode ray tube of directly heating type, such a deformation takes place as to elongate the Ni powders and compound oxides-baked surface of the cathode, but the deformation is completely discontinued after the continuous service for about 20 to about 30 hours.

It has been clarified that such deformation of the cathode is basically caused by a progress of mutual diffusion between the cathode substrate body of alloy of 15 to 30% by weight of W and 0.1 to 1.5% by weight of Zr, the balance being Ni, and the baked Ni powders. That is, when the Ni powders are baked onto the cathode substrate body, W and Zr in the cathode substrate body diffuse into the baked Ni powder layer, and also Ni diffuses into the cathode substrate body, whereby a diffusion layer is formed between the baked Ni powder layer and the cathode substrate body. The resulting state is given in FIG. 2, where FIG. 2 (a) shows a state of the Ni powders 4 being applied onto the cathode substrate body 1, and FIG. 2 (b) a state of a diffusion layer 5 being formed between the cathode substrate body 1 and the Ni layer 4.

In FIG. 3, results of measuring mean coefficients of thermal expansion of alloys of Ni-W-0.4% Zr between room temperature (30° C.) and 900° C. by changing the content of W are shown. The coefficients of thermal expansion is reduced with increasing content of W. As is readily presumable from the results of FIG. 3, the coefficients of thermal expansion of the diffusion layer shown in FIG. 2 (b) are larger than that of the cathode substrate body.

Besides the deformation due to the difference in the coefficients of thermal expansion, it has been found that a deformation due to differences in diffusion coefficients of Ni and W is superposed thereon. That is, the diffusion coefficient of Ni from the Ni powder layer to the cathode substrate body is about three times as large as that of W from the cathode substrate body to the Ni powder layer. Therefore, the cathode substrate body in contact with the Ni powder layer receives Ni diffusing from the Ni powder layer, forming many pores, and consequently expands.

The mutual diffusion between the Ni powder layer and the cathode substrate body rapidly proceeds, when there is a sharp difference in concentrations of Ni, W, etc. between the Ni powder layer and the cathode substrate body, as shown in FIG. 2 (c). When changes in the concentrations of Ni, W, etc. get sloped with passing time of mutual diffusion, for example, as shown in FIG. 2 (d), the process of mutual diffusion is restrained, and at the same time the difference in the coefficients of thermal expansion between the diffusion layer and the cathode substrate body is reduced, whereby no thermal deformation of the cathode substrate body takes place. That the thermal deformation takes place when the Ni powders or compound oxides are baked onto the cathode substrate body or during the service for about 20 hours where the cathode is used as a cathode ray tube of directly heating type, and the deformation is discontinued thereafter, as pointed out above, is based on the foregoing grounds, and the present invention is based on these findings.

The present invention provides a process for producing a cathode for a cathode ray tube of directly heating type, which comprises shaping a heat-resistant and electro-conductive, flat metal plate, into a cathode substrate body having two leg pieces extended in the same direction and a flat part connected to one end of each leg piece; forming a heat-diffusible metal powder layer having a good affinity to said flat metal plate and on an outer surface of said flat part; heating the powder layer, thereby diffusion bonding the powder layer to the flat part and forming a bonding layer having an uneven surface, to which a thermionic emission layer is to be bonded; and forming the thermionic emission layer on the surface of the bonding layer, characterized by forming on said flat metal plate a metal layer having a good affinity to the flat metal plate, by diffusion bonding, thereby forming a compound plate, and shaping the resulting compound plate into the shape of said cathode substrate body.

That is, according to the present invention, a process for producing a cathode for a cathode ray tube of directly heating type is provided, which comprises providing a metal layer comprising not more than 10% by weight of at least one of W and Mo, and not more than 1.5% by weight of Zr, the balance being at least one of Ni and Co at least at one side of a flat metal plate of an alloy comprising 15 to 30% by weight of at least one of W and Mo, and 0.1 to 1.5% by weight of Zr, the balance being at least one of Ni and Co, then heating the flat metal plate, thereby diffusing Ni into the flat metal plate and forming a compound plate; shaping the compound plate into a cathode substrate body having a desired cathode shape; placing Ni powders on the substrate body; heating the substrate body, thereby diffusing Ni into the cathode substrate body; and then providing a thermionic emission layer thereon.

In the present invention, a flat plate of alloys of 15 to 30% by weight of W and 0.1 to 1.5% by weight of Zr, the balance being Ni, that is, the ordinary cathode substrate body of directly heating type, is used as the flat metal plate. As already mentioned above, 7 to 15% of W or all the portion of W can be replaced with Mo, and 20 to 50% or all the portion of Ni can be replaced with Co. Thickness (t) of the flat metal plate of the alloy is properly determined in view of the successive cold rolling.

The flat metal plate of the alloy can be most preferably produced by shaping a powdery mixture of the respective constituent metal powders under pressure, then sintering the mixture, and cold rolling the sintered mixture. The thickness of the flat plate is determined also in view of its electrical resistance, but usually is 100 μm or less, preferably 20 to 50 μm.

Then, said metal layer is provided at one side or both sides of the flat metal plate of the alloy. For producing a cathode, the metal layer can be provided only at one side on which the thermionic emission layer is to be provided, but the metal layer can be also provided at both sides to prevent a strain to be developed when said diffusion layer is to be formed in the successive step by heating the flat metal plate having the metal layer only on one side to diffuse Ni into the flat metal plate.

The layer comprising not more than 10% by weight of at least one of W and Mo, and not more than 1.5% by weight of Zr, the balance being at least one of Ni and Co means a layer consisting of at least one of Ni and Co, when the contents of W, Mo and Zr are zero.

When the thickness in total of the layers comprising at least one of Ni and Co at both face and back sides of flat metal plate is less than 1% of the thickness of the cathode substrate body, no effect is obtained upon the prevention of the thermal deformation, but when the thickness exceeds 15% of the thickness of the cathode substrate body, the electrical resistance of the entire cathode is lowered by formation of thick metal layer of Ni, Co, or Ni-Co having a small electrical resistance on the cathode substrate body having a large electrical resistance, and it takes a longer time in actuation as the cathode and at the same time fluctuations are large, cathode by cathode, though the thermal deformation can be prevented. Therefore, preferable thickness in total of the metal layers at both face and back sides of the cathode substrate body is 1 to 15% of the thickness of the cathode substrate body.

As a means for providing a dense metal layer of Ni, Co, or Ni-Co, such methods are available as by plating, vapor deposition, CVD, ion plating, foil or plate cladding, etc., but the plating method is most preferable.

Any of electrolytic plating method and chemical plating method can be used as the plating method. For example, in the case of Ni, electrolytic plating is carried out in the ordinary Ni plating bath, for example, a bath containing 150 g/l of nickel sulfate, 15 g/l of ammonium chloride, and 15 g/l of boric acid (pH 6.0) at a bath temperature of 25° C. and a current density of 1 A/dm$^2$. Also in the case of Co or Ni-Co alloy, the ordinary plating method is employed.

Since the mutual diffusion between the Ni powder layer and the cathode substrate layer is based on the diffusion of Ni from the Ni powder layer to the cathode substrate body and the diffusion of Ni from the cathode substrate body to the Ni powder layer, as already described above, the diffusion layer has a composition similar to that of the cathode substrate body. Thus, a layer of alloy can be provided as a substitute for the Ni layer, and a composition for the alloy metal constituents can be properly selected within the range for the alloy composition of the cathode substrate body. In the case of an alloy layer containing 5 to 10% by weight of W and not more than 1.5% of Zr, the balance being at least one of Ni and Co, Zr has no effect upon the thermal deformation, and thus can be eliminated, but W or Mo has an effect upon the thermal deformation. That is, an alloy can be properly selected from the systems Ni-W, Ni-Mo, Ni-W-Mo, Ni-Co-W, Ni-Co-Mo, and Ni-Co-W-Mo, and further an alloy can be properly selected from the alloys of these systems further containing Zr. The layer of these alloys can be provided on the cathode substrate body in the same manner as in the case of the Ni layer. Especially, a desirable foil or plate of these alloys can be produced by sintering a mixture of Ni, Co, W, Mo, and Zr powders in a desired mixing ratio into a plate, for example, 10 mm thick × 80 mm wide × 150 mm long, cold rolling and annealing in vacuum the resulting plate (the annealing conditions: 800° to 1,000° C., and $10^{-5}$ torr or less) to several repetitions, for example, in such steps as 5 mm thick × 80 mm wide × 250 mm long → 2 mm thick × 80 mm wide × 700 mm long → 1 mm thick × 80 mm wide × 1,300 mm long → 0.4 mm thick × 80 mm wide × 2,500 mm long.

When a layer of not more than 10% by weight of at least one of Mo and W and not more when 1.5% by weight of Zr, the balance being at least one of Ni and Co, that is, a layer of at least one of Ni and Co, or a layer of its alloy, is provided on the flat metal plate, and then heated in vacuum, mutual diffusion of Ni and Co, and W, Mo, and Zr takes place between the layer and the flat metal plate, and a diffusion layer having a gradually sloped change in concentrations of Ni, Co, W, Mo, and Zr can be formed. By the heat treatment a room for the thermal deformation can be eliminated.

A preferable embodiment of the present invention provides a process for producing a cathode for a cathode ray tube of directly heating type, which comprises shaping a flat metal plate of 25 to 30% by weight of tungsten and 0.2 to 0.8% by weight of zirconium, the balance being nickel, into a cathode substrate body having two leg pieces extended in the same direction, and a flat part connected to one end of each leg piece; forming a nickel powder layer on an outer surface of said flat part; heating the powder layer, thereby diffusion bonding the powder layer to the flat part and forming a bonding layer having an uneven surface, to which a thermionic emission layer is to be bonded; and forming the thermionic emission layer on the surface of the bonding layer, characterized by forming on said flat metal plate a nickel plating layer 1 to 15% as thick as the flat metal plate by diffusion bonding, thereby forming a compound plate, and shaping the resulting compound plate into the shape of said cathode substrate body.

A further embodiment of the present invention provides a process for producing a cathode for a cathode ray tube of directly heating type, which comprises shaping a heat-resistant and electro-conductive, flat metal plate, into a cathode substrate body having two leg pieces extended in the same direction and a flat part connected to one end of each leg piece, forming a heat-diffusible metal powder layer having a good affinity to said flat metal plate and on an outer surface of said flat part, heating the powder layer, thereby diffusion bonding the powder layer to the flat part and forming a bonding layer having an uneven surface, to which a thermionic emission layer is to be bonded, and forming the thermionic emission layer on the surface of the bonding layer, characterized by forming on said flat metal plate a metal layer having a good affinity to the flat metal plate by diffusion bonding, then applying a plastic working to the flat metal plate to a desired thickness, thereby forming a compound plate, and shaping the resulting compound plate into the shape of said cathode substrate body.

That is to say, according to the present invention, a metal layer of not more than 10% by weight of at least one of W and Mo and not more than 1.5% by weight of Zr, the balance being at least one of Ni and Co is bonded to at least one side of a flat metal plate containing 15 to 30% by weight of at least one of W and Mo, and 0.1 to 1.5% by weight of Zr, the balance being at least one of Ni and Co, by diffusion, then the flat metal plate is subjected to plastic working to a desired thickness, thereby forming a compound plate, and a cathode is produced from the compound plate in the manner as already described above.

The compound plate comprised of the flat metal plate and the metal layer having a composition similar to that of the flat metal plate and being bonded to the flat metal plate by diffusion is cold rolled to a desired thickness, for example, 30μ thick, thereby preparing a cathode substrate body corresponding to 1 in FIG. 1. To obtain the desired thickness, the cold rolling is carried out by two repetitions of cold rolling and vacuum annealing in the following order, if the thickness of the compound plate having a diffusion layer thereon is 1 mm.

1 mm thick → 0.4 mm thick → 0.03 mm thick

A cathode substrate body in cathode shape is prepared from the compound plate by punching, and Ni powders are placed on the cathode substrate body. Then, the substrate body is heated to form a diffusion layer in advance, and then a solution of compound carbonate of barium, strontium and calcium, for example, a solution prepared by mixing 100 g of the carbonate with 100 g of nitrocellulose and 10.0 l of butyl acetate in a ball mill for 40 hours, is applied to the substrate body. Then, the substrate body is calcined at a high temperature to convert the carbonate to its compound oxides, and a thermionic emission layer is formed thereby.

Another preferable embodiment of the present invention provides a process for producing a cathode for a cathode ray tube of directly heating type, which comprises shaping a flat metal plate of 25 to 30% by weight of tungsten and 0.2 to 0.8% by weight of zirconium, the balance being nickel, into a cathode substrate body having two leg pieces extended in the same direction, and a flat part connected to one end of each leg piece; forming a nickel powder layer on an outer surface of said flat part; heating the powder layer, thereby diffusion bonding the powder layer to the flat part and forming a bonding layer having an uneven surface, to which a thermionic emission layer is to be bonded; and forming the thermionic emission layer on the surface of the bonding layer, characterized by forming on said flat metal plate a nickel plating layer 1 to 15% as thick as the flat metal plate by diffusion bonding and then applying a plastic working to the flat metal plate to a desired thickness, thereby forming a compound plate, and shaping the resulting compound plate into the shape of said cathode substrate body.

Still other embodiment of the present invention provides a process for producing a cathode for a cathode ray tube of directly heating type, which comprises shaping a flat metal plate of 25 to 30% by weight of tungsten and 0.2 to 0.8% by weight of zirconium, the balance being nickel, into a cathode substrate body having two leg pieces extended in the same direction, and a flat part connected to one end of each leg piece; forming a nickel powder layer on an outer surface of said flat part; heating the powder layer, thereby diffusion bonding the powder layer to the flat part and forming a bonding layer having an uneven surface, to which a thermionic emission layer is to be bonded; and forming the thermionic emission layer on the surface of the bonding layer, characterized by forming on said flat metal plate and alloy layer of 5 to 10% by weight of tungsten and 0.2 to 0.8% by weight of zirconium, the balance being nickel, the alloy layer being 1 to 15% as thick as the flat metal plate, by diffusion bonding and then applying a plastic working to the flat metal plate to a desired thickness, thereby forming a compound plate, and shaping the resulting compound plate into the shape of said cathode substrate body.

The cathode of directly heating type produced according to the present invention never undergoes thermal deformation during the service period on account of eliminating causes for the thermal deformation in the course of the production.

Now, the present invention will be described in detail, referring to Examples, but will never be restricted to these Examples.

EXAMPLE 1

An alloy plate of 28% by weight of Ni and 0.4% by weight of Zr, the balance being Ni was prepared according to sintering method and made 30μ thick by plastic working, and a cathode substrate body was punched from the resulting flat metal plate.

Ni powders were applied to one side of the substrate body to a thickness of 2 mg/cm$^2$, and heated at 900° C. in vacuum for 30 minutes to bake the Ni powders onto the cathode surface. Then, a bending of the cathode (a height of curvature caused by thermal deformation, Δl) was measured, Δl was 25 to 35μ. Without correcting the curvature after the baking of the Ni powders, a solution of (Ba, Sr, Ca)$CO_3$ having the same composition as described earlier as one example, was applied to the substrate body to a thickness of 2 mg/cm$^2$, and then heated at 1,000° C. for 30 minutes, thereby forming a thermionic emission layer. Bending of the cathode, Δl, was in a range of 40 to 50μ.

EXAMPLE 2

A flat metal plate of an alloy of 28% by weight of W and 0.4% by weight of Zr, the balance being Ni, having a thickness of 30μ prepared in the same manner as in Example 1 was subjected to Ni plating at both sides to a thickness of 1μ (thickness at one side), and then heated to form a compound plate. A cathode substrate body was shaped from the compound plate, and then pure Ni powders were applied to one side of the substrate body to a thickness of 2 mg/cm$^2$, and heated at 900° C. for 30 minutes to bake the Ni powders onto the substrate body. Then, the same solution of (Ba.Sr.Ca)$CO_3$ as used in Example 1 was applied to the substrate body to a thickness of 2 mg/cm$^2$, and heated at 1,000° C. for 6 hours to form a thermionic emission layer. Then, a bending of the resulting cathode was measured.

When the Ni plating layers were provided at both sides of the cathode substrate body, thermal deformation in Δl was about 2 to about 3μ, but when the cathode was prepared similarly without providing the Ni plating layer on the substrate body, the thermal deformation in Δl was 40 to 55μ. that is, the deformation due to mutual diffusion and the deformation due to decomposition of the carbonate can be considerably reduced by providing the dense Ni plating layer on the substrate body.

EXAMPLE 3

To observe an influence of a thickness of the Ni plating layer, flat metal plates of an alloy of 28% by weight of W and 0.4% by weight of Zr, the balance being Ni, having a thickness of 30μ, were subjected to Ni plating at both sides to thicknesses of 0.05μ and 0.5μ (thickness at one side) and then heated. Cathode substrate bodies were prepared from the resulting compound plates, and Ni powers were applied to the substrate bodies to a thickness of 2 mg/cm$^2$, and baked at 800° C. in vacuum for 30 minutes. Further, the same solution of (Ba.Sr.Ca)$CO_3$ as used in Example 1 was applied to the substrate bodies to a thickness of 2 mg/cm$^2$, and heated at 1,000° C. for 6 hours to form a thermionic emission layer. Then, deformations of the resulting cathodes were measured.

In the case that the thickness of Ni plating layer was 0.05μ, the deformation in Δl was 25 to 40μ, but in the case the Ni plating had the thickness of 0.5μ, the thermal deformation of the cathode substrate body was very small and was within the range of errors of measurements. That is, it is necessary that a thickness of Ni plating layer is at least 0.1μ.

EXAMPLE 4

A flat metal plate of alloy of 28% by weight of W and 0.4% by weight of Zr, having a thickness of 0.35 mm was subjected to Ni plating at one side to a thickness of 30μ, and heated at 1,000° C. in vacuum for 15 hours to form a diffusion layer. The resulting compound plate was cold rolled to a thickness of 30μ, and a cathode substrate body was punched from the compound plate. Then, a thermionic emission layer was formed in the same manner as in Example 1. In the present Example, the Ni plating and the cold rolling were carried out according to the ordinary procedures.

Δl after the baking of Ni powders and Δl after the formation of the thermoionic emission layer were measured, and were formed each 2 to 3μ, which were in the range of errors of measurements.

In another run, the flat metal plate was subjected to Ni plating at both sides to a thickness of 3 μ (thickness at one side), and a cathode was prepared in the same manner as above. The cathode was heated at 800° C. in vacuum for 100 hours, and Δl was measured, and found not more than 2–3 μ.

EXAMPLE 5

An alloy plate of 10% by weight of W and 0.4% by weight of Zr, the balance being Ni, having a thickness of 1 mm, was placed on one side of a flat metal plate of alloy of 28% by weight of W and 0.4% by weight of Zr, the balance being Ni, having a thickness of 10 mm, and heated at 1,000° C. in vacuum for 20 hours to form a diffusion layer. The resulting compound plate was cold rolled to a thickness of 30 μ, and a cathode substrate body was shaped by punching from the compound plate. A thermionic emission layer was provided on the cathode substrate body in the same manner as in Example 1. Δl after the baking of Ni powders and Δl after the formation of the thermionic emission layer were each not more than 2–3 μ. Δl after further heating at 800° C. in vacuum for 100 hours was also not more than 2–3 μ.

Similar results were obtained when the alloy plates of 10% by weight of W and 0.4% by weight of Zr, the balance being Ni, having a thickness of 1 mm were placed on both sides of the flat metal plate.

EXAMPLE 6

Cathode was prepared in the same manner as in Example 5, except that a pure Ni plate was used in place of the alloy plate of 10% by weight of W and 0.4% by weight of Zr, the balance being Ni, of Example 5. Δl after the baking of Ni powders and Δl after the formation of thermionic emission layer were each not more than 2–3 μ.

Another cathode was prepared in the same manner as in Example 5, except that an alloy plate of 15% by weight of W and 0.4% by weight of Zr, the balance being Ni, where the W content was increased, was used in place of the alloy plate of 10% by weight of W and 0.4% by weight of Zr, the balance being Ni. It was observed that Δl was increased in an order of 10 μ, and it is thus appropriate that a composition range of the alloy plate to be bonded to the cathode substrate body of alloy of 15 to 30% by weight of W and 0.1 to 1.5% by weight of Zr, the balance being Ni, by diffusion, is 0 to 10% by weight of W and 0 to 1.5% by weight of Zr, the balance being Ni.

It is evident from the foregoing Examples that a thermal deformation of cathode, which is a fatal trouble to a cathode ray tube of directly heating type, can be completely prevented, and a life of the cathode is increased according to the present invention.

We claim:

1. A process for producing a cathode for a cathode ray tube of directly heating type, which comprises:

(a) preparing a compound plate of predetermined thickness comprising a heat-resistant and electroconductive flat metal plate and a thin metal layer having an affinity to the flat metal plate, the thin metal layer being diffusion bonded to the flat metal plate, (b) shaping said compound plate into a cathode substrate body having two leg pieces extended in the same direction and a flat part being connected to one end of each leg piece and having said metal layer on an outer surface of said flat part, (c) forming a bonding layer, for bonding a thermionic emission layer, by diffusion bonding powders of a thermally diffusible metal having an affinity to said metal layer to the outer surface of the flat part, and (d) forming the thermionic emission layer on the surface of the bonding layer.

2. A process according to claim 1, wherein the flat metal plate is comprised of an alloy of 15 to 30% by weight of at least one of tungsten and molybdenum, and 0.1 to 1.5% by weight of zirconium, the balance being at least one of nickel and cobalt.

3. A process according to claim 1, wherein the powders of a thermally diffusible metal used for forming the bonding layer are nickel powders.

4. A process according to claim 2, wherein the metal layer is comprised of not more than 10% by weight of at least one of tungsten and molybdenum, and not more than 1.5% by weight of zirconium, the balance being at least one of nickel and cobalt.

5. A process according to claim 1, wherein said predetermined thickness is a thickness permitting the compound plate to be used as a cathode substrate body.

6. A process according to claim 5, wherein the thin metal layer has a thickness of 1–15% of the thickness of the flat metal plate.

7. A process according to claim 6, wherein the compound plate is prepared by providing a metal layer on the flat metal plate by a method selected from the group consisting of plating, vapor deposition, CVD, ion plating, foil cladding, or plate cladding, and then diffusion bonding said metal layer to said flat metal plate.

8. A process according to claim 7, wherein the thermionic emission layer is formed by applying a solution comprising a compound selected from the group consisting of barium carbonate, strontium carbonate, and calcium carbonate to the bonding layer on the cathode substrate body and calcining the member formed thereby to convert the carbonate to the oxide.

9. A process for producing a cathode for a cathode ray tube of directly heating type, which comprises:

(a) preparing a compound plate by diffusion bonding a flat metal plate of predetermined thickness comprising 25–30% by weight of tungsten, 0.2–0.8% by weight of zirconium and the balance being nickel and a nickel layer having a thickness of 1–15%, on the basis of the thickness of the flat metal plate, on a surface of the flat metal plate, together, (b) shaping said compound plate into a cathode substrate body having two leg pieces extended in the same direction and a flat part being connected to one end of each leg piece and having said nickel layer on an outer surface of said flat part, (c) forming a bonding layer, for bonding a thermionic emission layer, by diffusion bonding powders of nickel to the outer surface of the flat part, and (d) forming the thermionic emission layer on the surface of the bonding layer.

10. A process according to claim 9, wherein the compound plate is prepared by providing a nickel layer on the flat metal plate by a method selected from the group consisting of plating, vapor deposition, CVD, ion plating, foil cladding, or plate cladding, prior to said diffusion bonding said nickel layer to said flat metal plate.

11. A process according to claim 9, wherein the thermionic emission layer is formed by applying a solution comprising a compound selected from the group consisting of barium carbonate, strontium carbonate, and calcium carbonate to the bonding layer on the cathode substrate body and calcining the member formed thereby to convert the carbonate to the oxide.

12. A process for producing a cathode for a cathode ray tube of directly heating type, which comprises:

(a) preparing a compound plate comprising a heat-resistant and electroconductive flat metal plate and a thin metal layer having an affinity to the flat metal plate, the thin metal layer being diffusion bonded to the flat metal plate, (b) cold rolling the compound plate to a predetermined thickness, (c) shaping the compound plate of predetermined thickness into a cathode substrate body having two leg pieces extended in the same direction and a flat part being connected to one end of each leg piece and having said metal layer on an outer surface of said flat part, (d) forming a bonding layer, for bonding a thermionic emission layer, by diffusion bonding powders of a thermally diffusible metal having an affinity to said metal layer to the outer surface of the flat part, and (e) forming the thermionic emission layer on the surface of the bonding layer.

13. A process according to claim 12, wherein the flat metal plate is comprised of an alloy of 15 to 30% by weight of at least one of tungsten and molybdenum, and 0.1 to 1.5% by weight of zirconium, the balance being at least one of nickel and cobalt.

14. A process according to claim 13, wherein the metal layer is comprised of not more than 10% by weight of at least one of tungsten and molybdenum, and not more than 1.5% by weight of zirconium, the balance being at least one of nickel and cobalt.

15. A process according to claim 12, wherein the powders of a thermally diffusable metal used for forming the bonding layer are nickel powders.

16. A process according to claim 12, wherein the predetermined thickness to which the compound plate is cold-rolled is a thickness permitting the compound plate to be used as a cathode substrate body.

17. A process according to claim 16, wherein the compound plate is prepared by providing a metal layer on the flat metal plate by a method selected from the group consisting of plating, vapor deposition, CVD, ion plating, foil cladding, or plate cladding, and then diffusion bonding said metal layer to said flat metal plate.

18. A process according to claim 17, wherein the thin metal layer has a thickness of 1–15% of the thickness of the flat metal plate.

19. A process according to claim 18, wherein the thermionic emission layer is formed by applying a solution comprising a compound selected from the group consisting of barium carbonate, strontium carbonate, and calcium carbonate to the bonding layer on the cathode substrate body and calcining the member formed thereby to convert the carbonate to the oxide.

20. A process for producing a cathode for cathode ray tube of directly heating type, which comprises:

(a) preparing a compound plate by diffusion bonding a flat metal plate comprising 25–30% by weight of tungsten, 0.2–0.8% by weight of zirconium and the balance being nickel, and a nickel layer having a thickness of 1–15%, on the basis of the thickness of the flat metal plate, on a surface of the flat metal plate, together, (b) cold rolling the compound plate to a predetermined thickness, (c) shaping the compound plate of predetermined thickness into a cathode substrate body having two leg pieces extended in the same direction and a flat part being connected to one end of each leg piece and having said nickel layer on an outer surface of said flat part, (d) forming a bonding layer, for bonding a thermionic emission layer, by diffusion bonding powders of nickel to the outer surface of the flat part, and (e) forming the thermionic emission layer on the surface of the bonding layer

21. A process according to claim 20, wherein the compound plate is prepared by providing a nickel layer on the flat metal plate by a method selected from the group consisting of plating, vapor deposition, CVD, ion plating, foil cladding, a plate cladding, prior to said diffusion bonding said nickel layer to the flat metal plate.

22. A process for producing a cathode for a cathode ray tube of directly heating type, which comprises:

(a) preparing a compound plate comprising a flat metal plate comprising 25–30% by weight of tungsten, 0.2–0.8% by weight of zirconium, and the balance being nickel, and a thin metal layer having a thickness of 1–15%, on the basis of the thickness of the flat metal plate, and comprising 5–10% by weight of tungsten, 0.2–0.8% by weight of zirconium, and the balance being nickel, the thin metal layer being diffusion bonded to the flat metal plate, (b) cold rolling the compound plate to a predetermined thickness, (c) shaping the compound plate of predetermined thickness into a cathode substrate body having two leg pieces extended in the same direction and a flat part being connected to one end of each leg piece and having said metal layer on an outer surface of said flat part, (d) forming a bonding layer, for bonding a thermionic emission layer, by diffusion bonding powders of nickel to the outer surface of the flat part, and (e) forming the thermionic emission layer on the surface of the bonding layer.

23. A process according to claim 22, wherein the compound plate is prepared by providing a nickel layer on the flat metal plate by a method selected from the group consisting of plating, vapor deposition, CVD, ion plating, foil cladding, or plate cladding, and then diffusion bonding said metal layer to the flat metal plate.

24. A process for producing a cathode for a cathode ray tube of directly heated type, which comprises:

(a) preparing a compound plate comprising a heat-resistant and electroconductive flat metal plate and thin metal layers having an affinity to the flat metal plate, the thin metal layers being diffusion bonded to each side of the flat metal plate, (b) shaping said compound plate into a cathode substrate body having two leg pieces extended in the same direction and a flat part being connected to one end of each leg piece, said flat part having one of the metal layers on an outer surface thereof, (c) forming a bonding layer, for bonding a thermionic emission layer, by diffusion bonding, to the metal layer on the outer surface of the flat part, powders of a thermally diffusible metal having an affinity to the metal layer on the outer surface of the flat part, and (d) forming the thermionic emission layer on the surface of the bonding layer.

* * * * *